US011857849B2

(12) United States Patent
Ripp et al.

(10) Patent No.: US 11,857,849 B2
(45) **Date of Patent: *Jan. 2, 2024**

(54) GOLF CLUB HEAD WITH TEXTURED STRIKING FACE

(71) Applicant: SUMITOMO RUBBER INDUSTRIES, LTD., Kobe (JP)

(72) Inventors: Patrick Ripp, Seal Beach, CA (US); Jeff D. Brunski, Los Angeles, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 121 days.

This patent is subject to a terminal disclaimer.

(21) Appl. No.: 17/324,789

(22) Filed: May 19, 2021

(65) Prior Publication Data

US 2021/0268343 A1 Sep. 2, 2021

Related U.S. Application Data

(60) Continuation of application No. 16/451,628, filed on Jun. 25, 2019, now Pat. No. 11,033,786, which is a division of application No. 15/793,538, filed on Oct. 25, 2017, now Pat. No. 10,376,755, which is a division of application No. 15/219,850, filed on Jul. 26, 2016, now Pat. No. 9,868,037.

(51) Int. Cl.
*A63B 53/04* (2015.01)

(52) U.S. Cl.
CPC ..... *A63B 53/047* (2013.01); *A63B 53/04* (2013.01); *A63B 53/0408* (2020.08); *A63B 53/0445* (2020.08); *A63B 2053/0479* (2013.01)

(58) Field of Classification Search
CPC ..... A63B 53/047; A63B 53/0445; A63B 2053/0479
See application file for complete search history.

(56) References Cited

U.S. PATENT DOCUMENTS

| | | | | |
|---|---|---|---|---|
| 1,965,954 | A * | 7/1934 | Henry | A63B 60/00 473/331 |
| 5,547,426 | A | 8/1996 | Wood | |
| 6,007,434 | A | 12/1999 | Baker et al. | |
| 6,482,104 | B1 | 11/2002 | Gilbert | |
| 6,530,846 | B1 | 3/2003 | Mase | |

(Continued)

OTHER PUBLICATIONS

Apr. 3, 2017 Office Action issued in U.S. Appl. No. 15/219,850.

(Continued)

*Primary Examiner* — Michael D Dennis
(74) *Attorney, Agent, or Firm* — Oliff PLC

(57) ABSTRACT

A golf club head includes a striking face with a plurality of scorelines. A first virtual vertical plane is perpendicular to the striking face and passes through a toe-wardmost extent of the scorelines, and a second virtual vertical plane is parallel to the first virtual vertical plane and passes through a heel-wardmost extent of the scorelines. A central region bounded by the first virtual vertical plane, the second virtual vertical plane, and a striking face periphery has a first average surface roughness Ra1 of between about 40 μin and about 180 μin. And a majority of a toe region bounded by the first vertical plane and the striking face periphery is textured to have a second average surface roughness Ra2 no less than 1.5 times Ra1.

19 Claims, 14 Drawing Sheets

(56) References Cited

U.S. PATENT DOCUMENTS

| | | | | |
|---|---|---|---|---|
| 7,166,039 | B2 | 1/2007 | Hettinger et al. | |
| 7,452,283 | B2 | 11/2008 | Hettinger et al. | |
| 7,540,810 | B2 | 6/2009 | Hettinger et al. | |
| 7,674,188 | B2 | 3/2010 | Ban | |
| 7,695,377 | B2 | 4/2010 | Yamagishi et al. | |
| 7,815,521 | B2 | 10/2010 | Ban et al. | |
| 7,918,747 | B2 | 4/2011 | Johnson et al. | |
| 7,976,404 | B2 | 7/2011 | Golden et al. | |
| 8,092,320 | B2 | 1/2012 | Yamagishi et al. | |
| 8,342,981 | B2 | 1/2013 | Johnson et al. | |
| 8,491,415 | B2 | 7/2013 | Ishikawa et al. | |
| 8,579,723 | B2 | 11/2013 | Nakamura | |
| 2004/0214654 | A1 | 10/2004 | Pelz | |
| 2005/0070374 | A1 | 3/2005 | Mahoney | |
| 2006/0025233 | A1 | 2/2006 | Lin | |
| 2008/0108453 | A1 | 5/2008 | Park et al. | |
| 2009/0318243 | A1 | 12/2009 | Golden et al. | |
| 2010/0029401 | A1 | 2/2010 | Nakamura | |
| 2011/0034270 | A1 | 2/2011 | Wahl et al. | |
| 2011/0086723 | A1 | 4/2011 | Gilbert et al. | |
| 2011/0200407 | A1* | 8/2011 | Petersen | A63B 53/047 409/203 |
| 2012/0264537 | A1 | 10/2012 | Breier et al. | |
| 2013/0310192 | A1 | 11/2013 | Wahl et al. | |
| 2013/0344988 | A1 | 12/2013 | Hettinger et al. | |
| 2014/0206472 | A1 | 7/2014 | Aguayo et al. | |
| 2014/0206473 | A1* | 7/2014 | Ripp | B23C 3/34 473/331 |
| 2014/0228143 | A1 | 8/2014 | Roach et al. | |
| 2014/0274451 | A1 | 9/2014 | Knight et al. | |
| 2015/0045142 | A1* | 2/2015 | Moreira | A63B 53/047 473/330 |
| 2015/0367197 | A1 | 12/2015 | Ripp et al. | |
| 2016/0193508 | A1 | 7/2016 | Issertell et al. | |
| 2016/0243412 | A1 | 8/2016 | Ines et al. | |
| 2017/0259134 | A1 | 9/2017 | Ines et al. | |

OTHER PUBLICATIONS

U.S. Appl. No. 15/219,850, filed Jul. 26, 2016 in the name of RIPP et al.

U.S. Appl. No. 15/793,538, filed Oct. 25, 2017 in the name of RIPP et al.

May 16, 2018 Office Action issued in U.S. Appl. No. 15/793,538.

Aug. 27, 2018 Office Action issued in U.S. Appl. No. 15/793,538.

Aug. 27, 2018 Office Action issued in U.S. Appl. No. 15/832,243.

Dec. 14, 2018 Office Action Issued in U.S. Appl. No. 15/793,538.

Dec. 20, 2018 Office Action issued in U.S. Appl. No. 15/832,243.

Jun. 27, 2019 Office Action issued in U.S. Appl. No. 15/832,243.

Nov. 20, 2019 Office Action issued in U.S. Appl. No. 15/832,243.

Jan. 21, 2020 Office Action issued in U.S. Appl. No. 16/451,628.

May 20, 2020 Restriction/Election Issued in U.S. Appl. No. 16/872,518.

Jun. 5, 2020 Office Action issued in U.S. Appl. No. 16/451,628.

Oct. 13, 2020 Office Action issued in U.S. Appl. No. 16/451,628.

Feb. 12, 2021 Notice of Allowance issued in U.S. Appl. No. 16/451,628.

Sep. 7, 2021 Office Action issued in U.S. Appl. No. 16/872,518.

Feb. 3, 2022 Notice of Allowance issued in U.S. Appl. No. 16/872,518.

Jul. 25, 2023 Office Action Issued In U.S. Appl. No. 17/738,187.

* cited by examiner

GOLF CLUB HEAD WITH TEXTURED STRIKING FACE

This is a continuation of U.S. patent application Ser. No. 16/451,628 filed Jun. 25, 2019, which in turn is a divisional of U.S. patent application Ser. No. 15/793,538 filed Oct. 25, 2017, which in turn is a divisional application of U.S. patent application Ser. No. 15/219,850 filed Jul. 26, 2016. The disclosure of each of the above-identified prior applications is hereby incorporated by reference in their entirety.

BACKGROUND

This disclosure relates generally to the field of golf clubs. More particularly, it relates to a golf club head with a textured striking face.

A common goal of golf club head design, specifically for iron-type and utility-type club heads, and more particularly for wedges, is to create a striking face for the club head that imparts significant spin to a struck golf ball. The striking face of such a club head typically has a plurality of parallel horizontal grooves or scorelines. These scorelines assist in imparting spin at least by channeling water and debris as well as by increasing the friction between the striking face and the surface of the golf ball. Further improvements in the spin-imparting characteristics of club head striking faces have included the provision of low-scale surface textures in addition to, or in place of, the conventional scorelines.

SUMMARY

The spin-imparting qualities provided by such scorelines are limited, however, by United States Golf Association ("USGA" hereinafter) regulations governing scoreline geometry as well as similar regulations propagated by other international golf equipment regulatory bodies. Moreover, conventional scorelines fail to account for low-scale dynamic interactions between the striking face and the ball.

Surface textures, on the other hand, tend not to take into account the specific interaction between a conventional elastomer-covered golf ball and a metallic striking face. Conventional surface texturing is also subject to rapid wear, is often costly to produce, and may detract from the aesthetic quality of the club head. Furthermore, conventional striking face textures are generally ineffective at providing a high degree of spin for each of the multitude of different types of golf shots that a golfer may attempt. For example, a ball hit with a club having a conventional club head that is swung at a specific speed would have different degrees of spin depending on whether the ball is squarely addressed by the club face or hit with an open club face, and also depending on where on the striking face the golf ball is struck, e.g., a mishit or a solidly struck shot. Other conditions, such as moisture on the club face and/or the ball, and whether the ball is struck with a full swing, half swing, or chip-type swing of the club, can affect the degree of spin imparted to the ball.

The creation of spin, particularly back-spin, on a struck golf ball is largely a function of the magnitude of the frictional contact or "traction" between the striking face of the club head and the ball on impact. Where a high degree of back-spin is desired, as in irons and wedges with higher loft angles, maximizing this traction factor is therefore a design goal. Increased traction is generally associated with increased average surface roughness of the striking face, which is commonly expressed in terms of Ra and defined as follows:

$$R_a = 1/n\Sigma_{i=1}^{n}|y_i|$$

where n is the number of sampling points and y is the deviation from a mean line (at a given sampling point). As a practical matter, Ra represents the average of deviations from a mean line over a 2-dimensional sample length of a surface. Another surface roughness parameter is average maximum profile height Rz, which represents the maximum average peak-to-trough distance in a given two-dimensional sample length of the surface.

The regulations of the USGA limit the surface roughness of the striking face of golf clubs generally to a degree of roughness no greater than that imparted by decorative sand-blasting or fine milling. In practical terms, this standard has been interpreted to mean a surface having a value of Ra no greater than 0.0046 mm (180 μin), and a value of Rz of no more than 0.025 mm (1000 μin). Thus, the need is evident to maximize the traction between the club face and the struck ball within the rules outlined by the USGA.

Also not to be overlooked, however, is the visual impact of a surface texture on the golfer. Depending on the orientation of the surface texture at address, it can either improve the golfer's confidence that the golf club head is properly aligned or it can have the exact opposite effect.

Accordingly, a textured striking face for a golf club head has been sought that imparts a high degree of spin to the ball for a wide variety of golf shots under a wide variety of conditions, that has good wear characteristics, that complies with USGA rules, that is easily manufactured, and that increases the golfer's confidence as the result of its visual appearance.

These goals may be achieved by one or more aspects of the present disclosure. For example, the present disclosure provides a golf club head that, when oriented in a reference position, comprises: a loft greater than 15 degrees; a heel portion; a toe portion; a sole portion; a top portion; and a striking face. The striking face in turn comprises a striking face periphery; a plurality of scorelines, wherein a first virtual vertical plane is perpendicular to the striking face and passes through a toe-wardmost extent of the scorelines and a second virtual vertical plane is parallel to the first virtual vertical plane and passes through a heel-wardmost extent of the scorelines; a central region bounded by the first virtual vertical plane, the second virtual vertical plane, and the striking face periphery, the central region having a first average surface roughness Ra1 of between about 40 μin and about 180 μin; and a toe region bounded by the first vertical plane and the striking face periphery, a majority of the toe region being textured to have a second average surface roughness Ra2 no less than 1.5 times Ra1.

The present disclosure also provides a golf club head comprising: a loft greater than 15 degrees; a heel portion; a toe portion; a sole portion; a top portion; and a striking face. The striking face in turn comprises a face center; a virtual circular central region centered at the face center, having a radius no less than 10 mm, and a first average surface roughness Ra1 no greater than about 180 μin; and a virtual circular periphery region located entirely peripheral to the central region and having a radius no less than 10 mm, the periphery region having a second average roughness Ra2 no less than 270 μin.

These advantageous golf club heads may be produced by a manufacturing method according to one or more aspects of the present disclosure. This method comprises (a) providing an intermediate golf club head body that, when oriented in a reference position, has a heel portion, a toe portion, a top portion, a bottom portion, and a striking face having a striking face periphery; (b) texturing a first region of the striking face to exhibit a first average surface roughness Ra1 of no less than 270 μin by surface milling the first region in a first pass; and (c) texturing a second region of the striking face subsequent to step (b), the second region exhibiting a second average surface roughness Ra2 that is less than Ra1.

These and other features and advantages of the golf club head according to the various aspects of the present disclosure will become more apparent upon consideration of the following description, drawings, and appended claims. The description and drawings described below are for illustrative purposes only and are not intended to limit the scope of the present invention in any manner. It is also to be understood that, for the purposes of this application, any disclosed range encompasses a disclosure of each and every sub-range thereof. For example, the range of 1-5 encompasses a disclosure of at least 1-2, 1-3, 1-4, 1-5, 2-3, 2-4, 2-5, 3-4, 3-5, and 4-5. Further, the end points of any disclosed range encompass a disclosure of those exact end points as well as of values at approximately or at about those endpoints.

DETAILED DESCRIPTION OF EMBODIMENTS

Figure 1A:
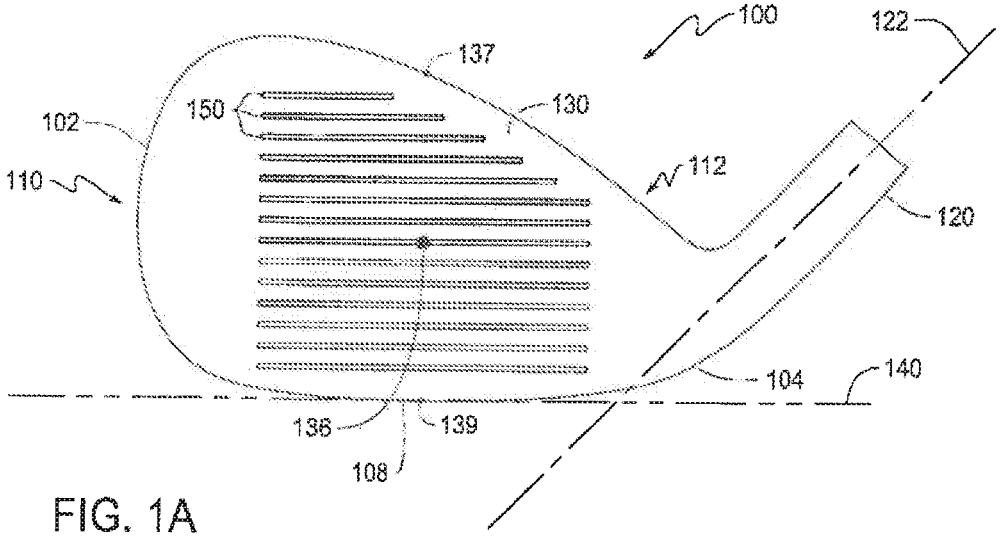
FIG. 1A shows a front elevation view of an exemplary golf club head in accordance with one or more aspects of the present disclosure.
Figure 1B:
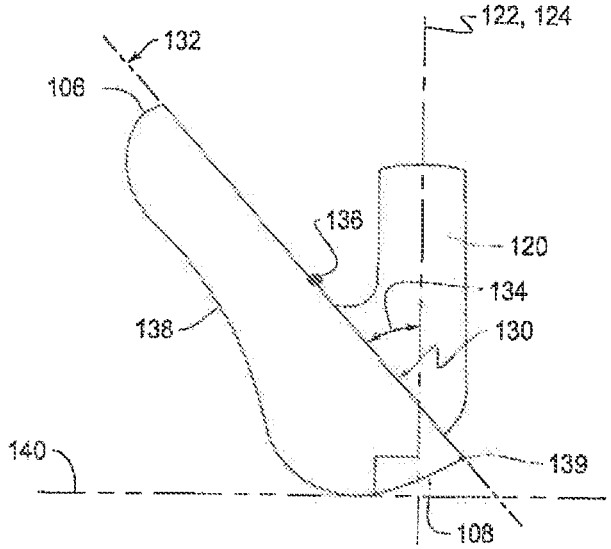
FIG. 1B shows a toe-side elevation view of the golf club head of FIG. 1A.

Shown in FIGS. 1A and 1B is a golf club head 100, which may be bounded by a toe 102, a heel 104 opposite the toe 102, a top line 106, and a sole 108 opposite the top line 106. The club head 100 may include, adjacent to the toe 102, a toe region 110, and adjacent to the heel 104, it may further possess a heel region 112. A hosel 120 for securing the club head 100 to an associated shaft (not shown) may extend from the heel region 112, and the hosel 120 may in turn define a virtual central hosel axis 122. The club head 100 may further include a striking face 130 at a front portion thereof and a rear face 138 opposite to the striking face 130. The striking face 130 is the substantially planar exterior surface part of the front portion that generally conforms to a virtual striking face plane 132 and that is arranged to contact a golf ball at a factory-designated loft angle 134 taken between the striking face plane 132 and the central hosel axis 122. The striking face 130 may include a face center 136 that is equidistant between the uppermost point 137 of the striking face 130 and the lowermost point 139 of the striking face 130 as well as equidistant between the heelward-most point of the striking face 130 and the toe-ward-most point of the striking face 130. Additionally, the striking face 130 may be formed with surface features that increase traction between the striking face 130 and a struck golf ball to ensure both good contact with the ball (for example, in wet conditions) and impart a degree of spin to the ball, e.g., for stability in flight or to better control a struck golf ball once it has returned to the ground by way of backspin. Included in these surface features may be a grid of substantially parallel horizontal grooves or scorelines 150 as well as other surface features that form a texture pattern and will be shown and described in detail below.

The golf club head 100 is shown in FIGS. 1A and 1B as being in the "reference position." As used herein, "reference position" denotes a position of a golf club head, e.g., the club head 100, in which the sole 108 of the club head 100 contacts a virtual ground plane 140 such that the hosel axis 122 of the hosel 120 lies in a virtual vertical hosel plane 124 and the scorelines 150 are oriented horizontally relative to the ground plane 140. Unless otherwise specified, all club head dimensions described herein are taken with the club head 100 in the reference position.

As the golfer nears the pin, precision in golf shots provided by, e.g., improved contact with the ball or increased backspin, generally becomes more critical than other considerations such as distance. The golf club head 100 that includes the above-mentioned surface features that increase traction is therefore preferably of an iron or a wedge type, although it could be a putter-type club head. In particular, the loft angle 134 may be at least 15 degrees and preferably between 23 and 64 degrees. Even more preferably, the loft angle 134 may be between 40 and 62 degrees, and yet even more preferably, this loft angle 134 may be between 46 and 62 degrees.

The golf club head 100 may preferably be formed of a metal, e.g., titanium, steel, stainless steel, or alloys thereof. More preferably, the main body of the club head 100 may be formed of 431 stainless steel or 8620 stainless steel. The main body of the club head 100 may be integrally or unitarily formed, or the main body may be formed of plural components that are welded, co-molded, brazed, or adhesively secured together or otherwise permanently associated with each other, as is understood by one of ordinary skill in the art. For example, the golf club head 100 may be formed of a main body of a first material and of a striking wall (including the striking face 130) of a second material different from the first and welded to the main body. The mass of the club head 100 may preferably be between 200 g and 400 g. Even more preferably, the mass of the golf club head 100 may be between 250 g and 350 g, and yet even more preferably, it may be between 275 g and 325 g.

Figure 2A:
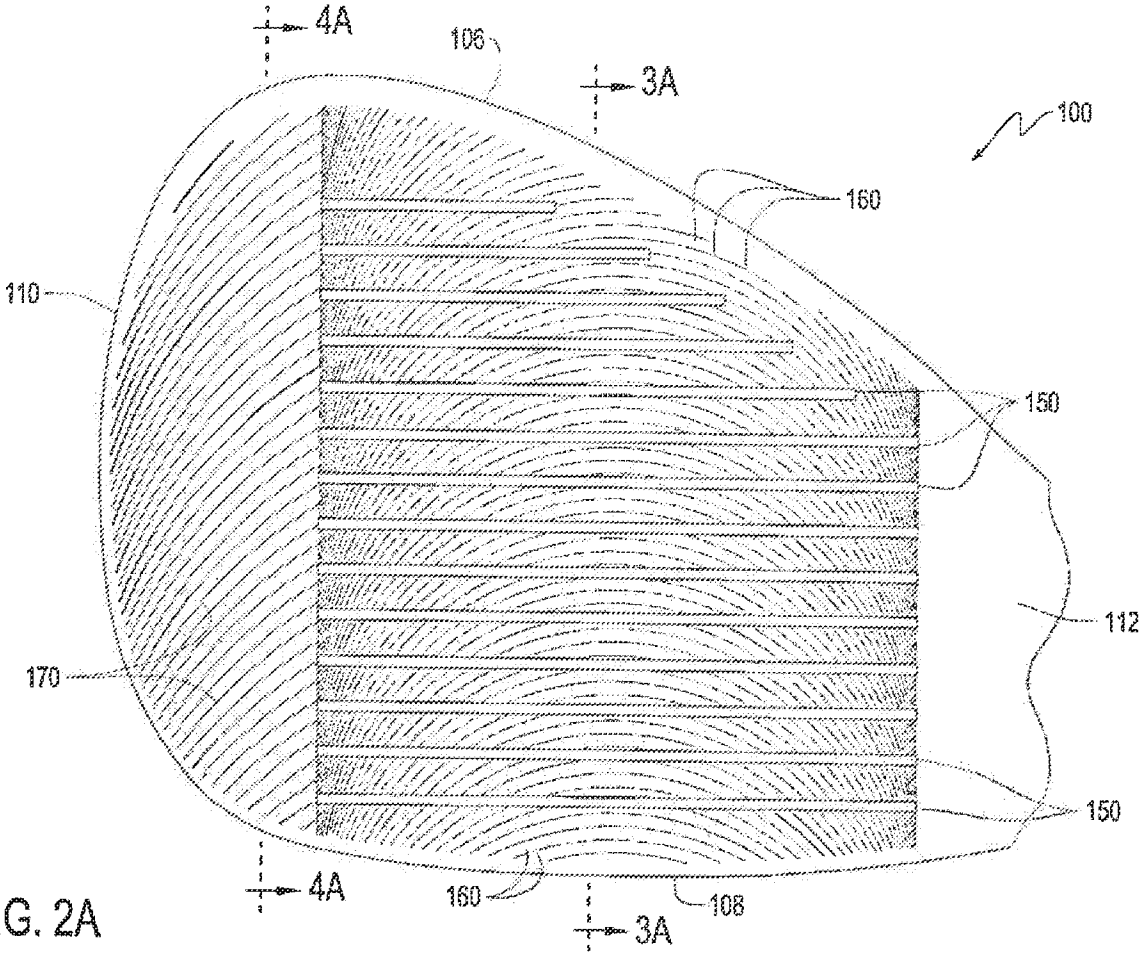
FIG. 2A shows a detailed, front elevation view of a portion of the golf club head of FIG. 1A.
Figure 2B:
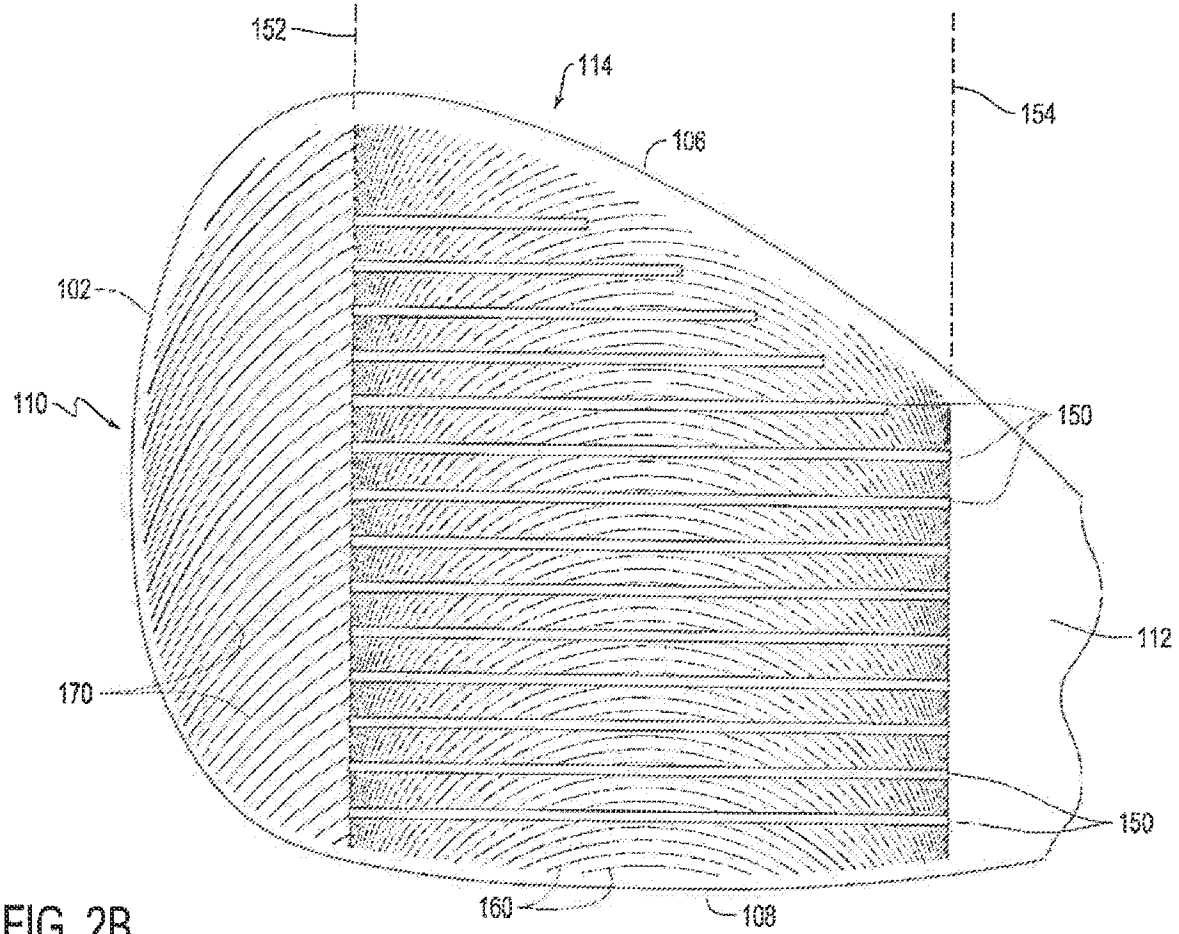
FIG. 2B shows another detailed, front elevation view of a portion of the golf club head of FIG. 1A.
Figure 2C:
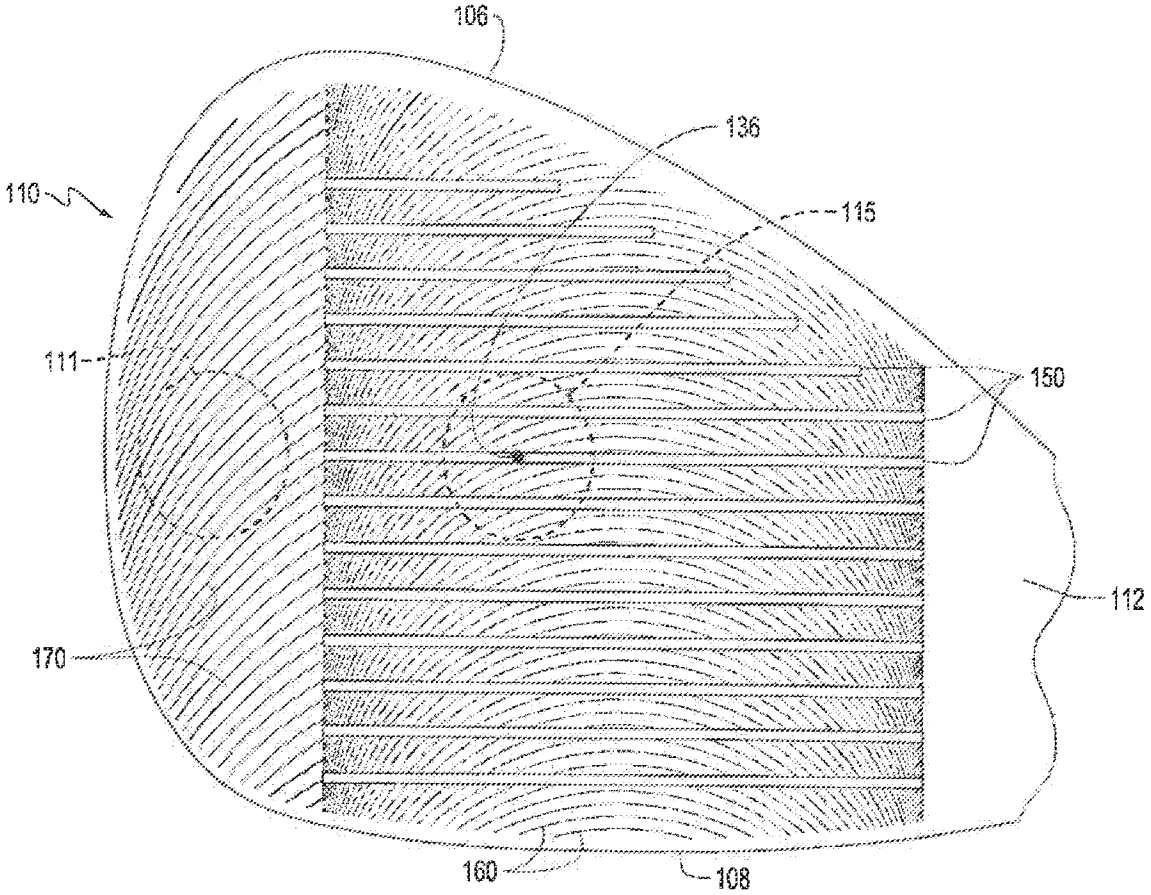
FIG. 2C shows yet another detailed, front elevation view of a portion of the golf club head of FIG. 1A.

FIGS. 2A-2C show enlarged views of a portion of the golf club head 100, and particularly of the striking face 130. As mentioned previously, the striking face 130 may include as surface features a plurality of substantially horizontal scorelines 150. These scorelines 150 are typically formed by mechanical milling, e.g., spin-milling, but they may alternatively be formed by stamping, casting, electroforming, or any other suitable known method. First and second virtual planes 152 and 154 (shown in FIG. 2B), which are perpendicular to the striking face plane 132 and which are respectively defined by the toeward-most extent and the heelward-most extent of the scorelines 150, delimit a scoreline region 114 of the striking face 130. The scoreline region 114 may also be referred to herein as a central region of the striking face 130. The first virtual plane 152 also delimits the heelward-most boundary of the toe region 110, and the second virtual plane 154 delimits the toeward-most boundary of the heel region 112.

The scorelines 150 may be designed to be in compliance with USGA regulations. These scorelines 150 may therefore preferably have an average width between 0.6 mm and 0.9 mm, more preferably between 0.65 mm and 0.8 mm, and even more preferably between 0.68 mm and 0.75 mm. For all purposes herein, and as would be understood by those of ordinary skill in the art, scoreline width is determined using the "30 degree method of measurement," as described in Appendix II of the current USGA Rules of Golf (hereinafter "Rules of Golf"). The scorelines 150 may have an average depth, measured according to the Rules of Golf, of no less than 0.10 mm, preferably between 0.25 mm and 0.60 mm, more preferably between 0.30 mm and 0.55 mm, and most preferably between 0.36 mm and 0.44 mm. To further comply with USGA regulations, the draft angle of the scorelines 150 as that term would be construed by one of ordinary skill may be between 0 and 25 degrees, more preferably between 10 and 20 degrees, and most preferably between 13 and 19 degrees. And the groove edge effective radius of the scorelines 150, as outlined in the Rules of Golf, may be between 0.150 mm and 0.30 mm, more preferably between 0.150 mm and 0.25 mm, and most preferably between 0.150 mm and 0.23 mm. Ultimately, the scoreline 150 dimensions may be calculated such that:

$$A/W+S \leq 0.0030 \text{ in}^2,$$

where A is the cross-sectional area of the scorelines 150, W is their width, and S is the distance between edges of adjacent scorelines, as outlined in the Rules of Golf.

With further reference to FIGS. 2A-2C, the striking face 130 may have formed therein additional surface features in the form of texture patterns constituted by very narrow, relatively shallow grooves, which may be called "micro-grooves." A first plurality of these micro-grooves 160, which may be formed by precision mechanical milling, e.g., CNC milling, may be located in the scoreline region 114 and are advantageously formed as a pattern of substantially parallel, arcuate lines intersecting the scorelines 150. The texture pattern constituted by the micro-grooves 160 preferably covers most, i.e., the majority, if not all, of the scoreline region 114 of the striking face 130. A second plurality of these micro-grooves 170, which are also advantageously formed as a pattern of substantially parallel, arcuate lines, may be located in the toe region 110. The texture pattern constituted by the micro-grooves 170 preferably covers most, if not all, of the toe region 110 of the striking face 130.

Figure 3B:
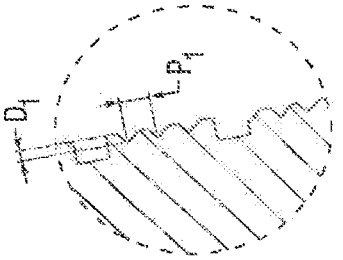
FIG. 3B shows a detailed view of a portion of the cross-sectional view of FIG. 3A.
Figure 3A:
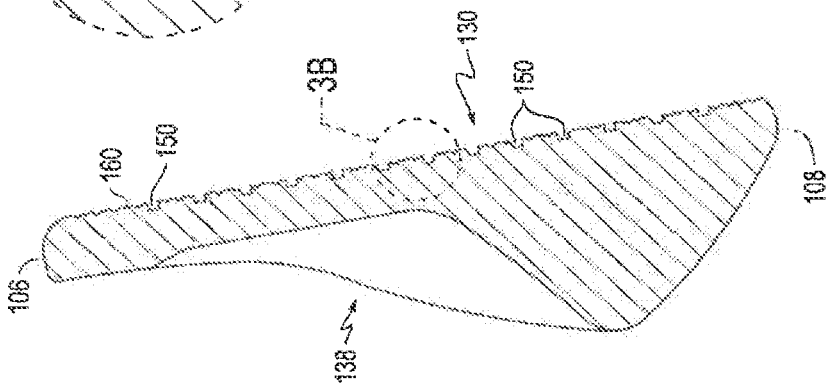
FIG. 3A shows a cross-sectional view of a portion of the golf club head of FIG. 2A taken through the plane 3A-3A.

FIGS. 3A and 3B show a cross-section taken through the plane 3A-3A shown in FIG. 2A, which intersects the scoreline region 114. The plane 3A-3A intersects not only the scorelines 150 but also the first plurality of micro-grooves 160. The micro-grooves 160 may preferably have an average depth D1 (shown in FIG. 3B) taken from the striking face 130 of no greater than 1100 μin, more preferably between 400 μin and 1100 μin, and most preferably between 600 μin and 1100 μin. The pitch P1 of these micro-grooves 160, i.e., the distance between centers of adjacent micro-grooves 160 taken in their direction of propagation, may preferably be between 0.01 in and 0.04 in, more preferably between 0.0175 in and 0.0325 in, and most preferably between 0.025 in and 0.03 in. As will be understood by those of ordinary skill in the art, the average depth D1 and pitch P1 of the micro-grooves 160 will have a significant impact on the roughness characteristics of the scoreline region 114. In particular, to ensure compliance with USGA regulations, the combination of the scorelines 150 and the texture pattern constituted by the micro-grooves 160 may imbue the scoreline region 114 with an average surface roughness Ra1 of preferably less than or equal to 180 μin. More preferably, the average surface roughness Ra1 may be between 40 μin and 180 μin, even more preferably between 100 μin and 180 μin, and it may most preferably be between 120 μin and 180 μin. And the average maximum profile height Rz1 of the scoreline region 114 may preferably be less than or equal to 1000 μin. More preferably, the average maximum profile height Rz1 may be between 300 μin and 1000 μin, even more preferably between 500 μin and 800 μin, and it may most preferably be between 600 μin and 700 μin.

Figure 4B:
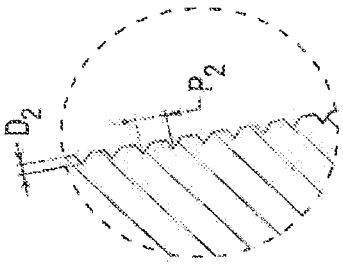
FIG. 4B shows a detailed view of a portion of the cross-sectional view of FIG. 4A.
Figure 4A:
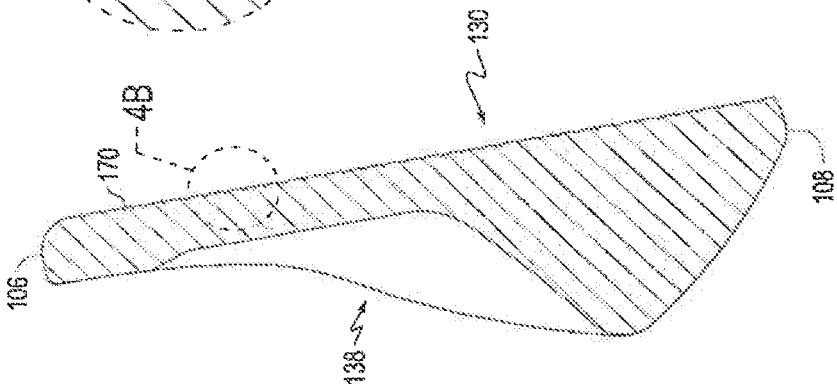
FIG. 4A shows a cross-sectional view of a portion of the golf club head of FIG. 2A taken through the plane 4A-4A.

FIGS. 4A and 4B in turn show a cross-section taken through the plane 4A-4A shown in FIG. 2A, which intersects the toe region 110. The plane 4A-4A intersects the second plurality of micro-grooves 170. The micro-grooves 170 may preferably have an average depth D2 (shown in FIG. 4B) taken from the striking face 130 of no less than 800 μin, more preferably between 1000 μin and 2000 μin, even more preferably between 1000 μin and 1800 μin, and most preferably between 1300 μin and 1600 μin. The pitch P2 of these micro-grooves 170, i.e., the distance between centers of adjacent micro-grooves 170 taken in their direction of propagation, may preferably be between 0.03 in and 0.06 in, more preferably between 0.035 in and 0.055 in, and most preferably between 0.04 in and 0.05 in. The depth D2 and the pitch P2 of the micro-grooves 170 may thus exceed the depth D1 and the pitch P2 of the micro-grooves 160. Similar to the micro-grooves 160, the average depth D2 and pitch P2 of the micro-grooves 170 will have a significant impact on the roughness characteristics of the toe region 110. In particular, the texture pattern constituted by the micro-grooves 170 may preferably imbue most, i.e., the majority, if not all, of the toe region 110 with an average surface roughness Ra2 of preferably greater than or equal to 270 μin. More preferably, the average surface roughness Ra2 may be greater than or equal to 300 μin, and even more preferably, it may be greater than or equal to 350 μin. In comparison to Ra1 of the scoreline region 114, Ra2 of the toe region 110 may preferably be greater than or equal to 1.5×Ra1, more preferably greater than or equal to 2×Ra1, and most preferably, Ra2 may be greater than or equal to 3×Ra1. Although at least a majority of the toe region 110 may have the average surface roughness Ra2, more preferably 80% of the toe region 110 may have the average surface roughness Ra2, and even more preferably 95% of the toe region 110 may have the average surface roughness Ra2. The average maximum profile height Rz2 of the toe region 110 may preferably be greater than or equal to 1000 μin. More preferably, the average maximum profile height Rz2 may be between 1000 μin and 2000 μin, even more preferably between 1200 μin and 1800 μin, and it may most preferably be between 1400 μin and 1600 μin.

FIG. 2C highlights certain portions of the striking face 130 by way of a virtual circular central region 115, which may be within the scoreline region 114, and a virtual circular periphery region 111, which may be within the toe region 110. Central region 115 may be centered at the face center 136, and it may have a radius of no less than 10 mm. The central region 115 may also possess the average roughness Ra1, and its average surface roughness may thus be no greater than 180 μin. Periphery region 111, like the central region 115, may have a radius of no less than 10 mm. This periphery region 111 may possess the average roughness Ra2, and its average surface roughness may thus be no less than 270 μin.

Figure 5:
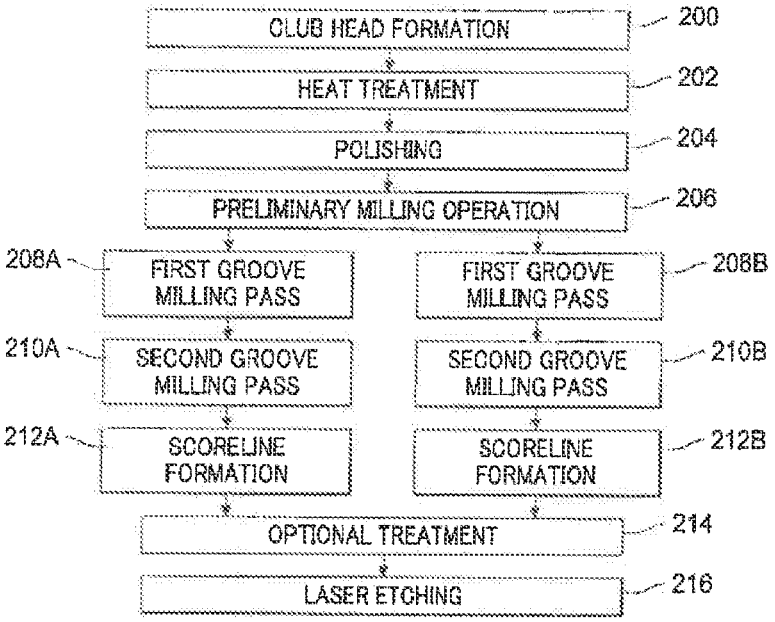
FIG. 5 shows a flow chart detailing methods of forming a textured striking surface on a golf club head in accordance with one or more aspects of the present disclosure.

Referring to FIG. 5, exemplary processes for forming the striking face 130 of the golf club head 100 by milling are shown. FIGS. 6A through 6F illustrate the club head 100 after performance of certain steps of the processes shown in FIG. 5. In each of FIGS. 6A through 6F, the club head 100 is oriented such that the striking face plane 132 coincides with the plane of the paper. The relative order of the various steps of the processes shown in FIG. 5 is for purposes of illustration only. One of ordinary skill in the art would appreciate that, unless indicated otherwise, various steps of the processes may be omitted, other steps may be added, or the relative order of such steps may be altered.

In a first step 200, the body of the golf club head 100 may be formed. It may be formed by casting. Alternatively, the main body of the club head 100 may be formed by forging, machining, and/or any other suitable method as known in the art. Once formed, in step 202, the club head body may optionally undergo a heat treatment process, whereby the club head body is case-hardened. Alternatively, or in addition, the body of the golf club head 100 may be cold-worked or otherwise forged to more advantageously tailor the body's material properties.

Next, in step 204, the body of the golf club head 100 may optionally be polished by way of sandblasting (or another media blasting process). This step 204 helps to remove any burrs or flashing that may have resulted from the club head formation step 200. In addition, the sandblasting process provides a foundation for an aesthetically pleasing final product.

Once polished, in step 206, the body of the golf club head 100 may undergo a preliminary milling operation particularly directed at the striking face 130. The preliminary milling operation may preferably be carried out using a machine bit, feed rate, and spin rate such that a resulting roughness value Ra is relatively low, e.g., an Ra value less than 40 μm. This process may be carried out as to preferably not result in any visually discernible ridges by, e.g., operating this process at a feed rate that is sufficiently high and/or a spin rate that is sufficiently low to generate this effect. In this manner, subsequent texture-enhancing processes may effect a final striking face 130 having metrological properties closer to target and more consistent from sample to sample. The body of the golf club head 100 may be referred to at this time as an intermediate golf club head body.

Figure 6A:
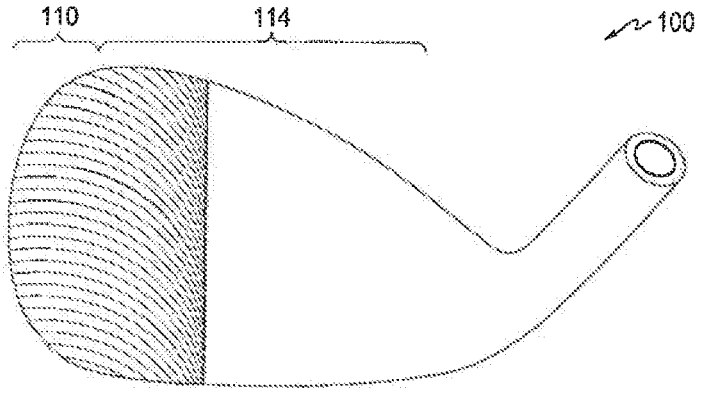
FIGS. 6A-6C show front elevation views of a golf club head that illustrate certain steps of the methods of FIG. 5.

After the preliminary milling operation of step 206, the striking face 130 of the intermediate golf club head body may be milled under a different set of machining parameters in a first groove milling pass to provide a milled surface having different visual and tactile characteristics. In particular, the first groove milling pass may create the extreme roughness Ra2 across at least the toe region 110. FIG. 6A, for example, shows the striking face 130 after one possible first groove milling pass 208A. The micro-grooves formed by this pass 208A cover the entire toe region 110 and even extend into the scoreline region 114, thereby imbuing these milled areas with the roughness Ra2.

Figure 6B:
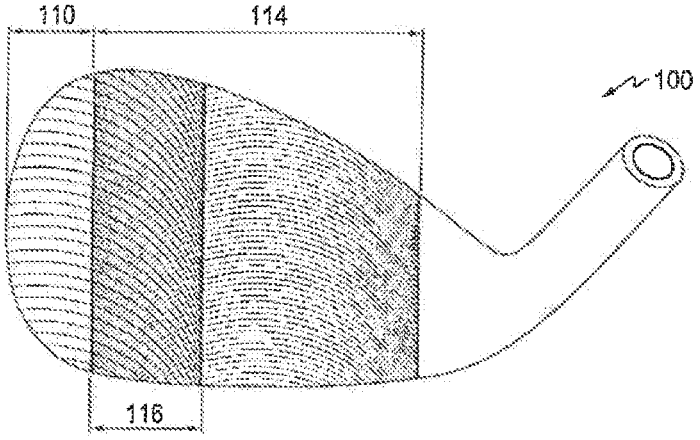
Figure 6C:
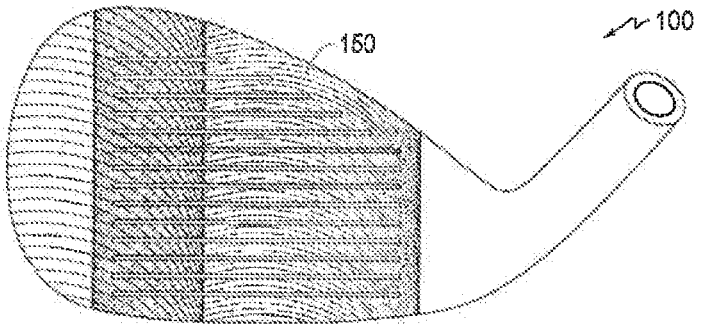
Figure 6D:
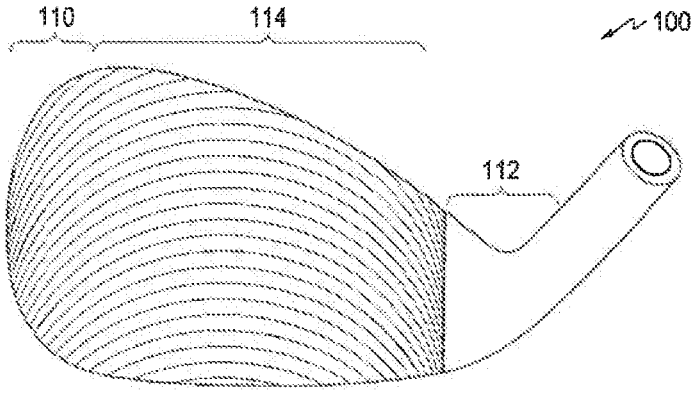
FIGS. 6D-6F show front elevation views of a golf club head that illustrate certain steps of the methods of FIG. 5.

An alternative first groove milling pass is shown in FIG. 6D. The micro-grooves formed by this pass 208B preferably cover the majority of the striking face 130, and they thus create the extreme roughness Ra2 across more of the striking face 130 than the first groove milling pass 208A. Although FIG. 6D shows the micro-grooves formed by the milling pass 208B as covering the toe region 110 and the scoreline region 114, the extreme roughness may also be carried into the heel region 112.

A second groove milling pass with yet a different set of machining parameters may then be performed on the striking face 130. Whereas the first groove milling pass created the extreme roughness Ra2, this second groove milling pass endeavors to lower the average roughness in at least the scoreline region 114 to comply with USGA regulations, thereby preferably leaving only the toe region 110 with the extreme roughness Ra2. The second groove milling pass may thus create the scoreline region 114 that is distinct from the toe region 110.

FIG. 6B shows the impact of a second groove milling pass 210A that may be performed on the golf club head 100 shown in FIG. 6A. This pass 210A may be limited to the scoreline region 114, and the heel region 112 in some implementations. As a result, the striking face 130 of this club head 100 is left with a toe region 110 with an extreme roughness Ra2 and a scoreline region 114, a majority of which possesses average roughness closer to or at Ra1. Also formed within the scoreline region 114, however, is an overlap region 116. This overlap region 116 was subjected to both the first and second groove milling passes 208A, 210A, and as a result, has a visual appearance different from that of the non-overlap regions of the striking face 130 but preferably still possesses Ra values closer to Ra1 at least within the scoreline region 114. This visual appearance difference is created by the grooves from the second milling pass 210A being superimposed onto the grooves formed by the first milling pass 208A.

Figure 6E:
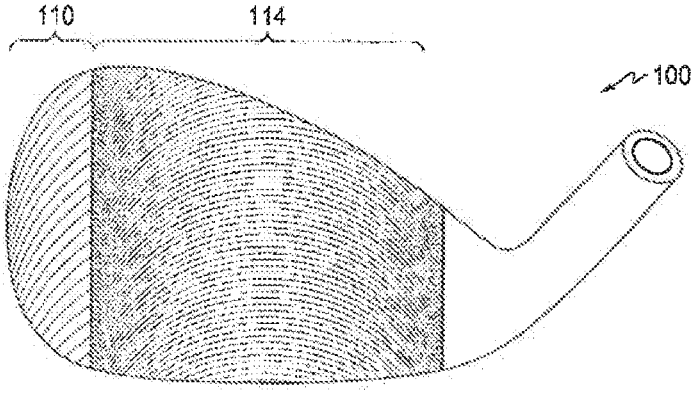

FIG. 6E in turn shows the impact of a second groove milling pass 210B that may be performed on the golf club head 100 shown in FIG. 6D. This pass 210B, like the pass 210A, may cover the entire scoreline region 114 (and possibly the heel region 112), thereby reducing the average roughness of the scoreline region 114 from the extreme roughness Ra2 imparted by the first groove milling pass 208B. Unlike the golf club head shown in FIG. 6B, the golf club head 100 shown in FIG. 6E, which is formed by the passes 208B and 210B, lacks the overlap region 116 due to the second groove milling pass 210B removing the material of the grooves formed by the first groove milling pass described in step 208B. As such, in some implementations, only the micro-grooves formed by the second pass 210B may remain in the scoreline region 114. In some implementations, the second groove milling pass 210B may remove the material of the grooves formed by the first groove milling pass described in step 208B as well as additional material of the club head 100 to form a visually discernible step between the higher grooves of the first groove milling pass and the lower grooves of the second groove milling pass.

Figure 6F:
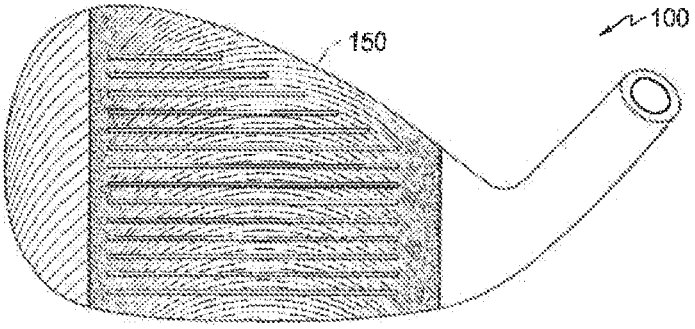

Next, the scorelines 150 may be formed on the striking face 130, thereby creating a club head body configuration as shown in FIGS. 6C and 6F. The score lines 150 may be integrally cast into the main body as a whole. Alternatively, the scorelines 150 may be stamped. However, the scorelines 150 may preferably be formed by milling, optionally spin-milling. This method is advantageous in its precision. Although it may occur prior to these operations, the formation of the scorelines 150 preferably occurs subsequent to the first and second groove milling passes. In this manner, greater consistency in roughness may be achieved as the milling bit may be applied with even pressure throughout. Further, the scorelines 150 may be formed with greater precision and more sharply-defined edges.

Optionally, after the scorelines 150 are formed, the golf club head 100, or just the striking face 130, may be plated or coated with a metallic layer, or treated chemically or thermally in a finishing step 214. Such treatments are well-known, and they may enhance the aesthetic qualities of the club head and/or one or more utilitarian aspects of the club head, e.g., durability or rust-resistance. For example, the golf club head 100 may be nickel-plated and optionally subsequently chrome-plated. Such plating enhances the rust-resistance characteristics of the club head 100. Further, such plating improves the aesthetic quality of the club head 100, and it may serve as a substrate for any future laser etching process. Plating selection is also believed to have an effect on the visual and/or textural characteristics of subsequently-formed laser-etched regions superimposed thereon. Optionally, subsequent to the nickel- and chrome-plating, the striking face 130 may undergo a physical vapor deposition ("PVD" hereinafter) process. Preferably, the PVD operation results in a layer that comprises either a pure metal or a metal/non-metal compound. Preferably, the PVD-formed layer comprises a metal comprising at least one of: vanadium, chromium, zirconium, titanium, niobium, molybdenum, hafnium, tantalum, and tungsten. More preferably, the PVD-applied layer is characterized as a nitride, a carbide, an oxide, or a carbonitride. For example, a layer of any of zirconium nitride, chromium nitride, and titanium carbide may be applied, depending on the desired visual effect, e.g., color and/or material properties. Preferably, the PVD operation results in a layer of titanium carbide. This process enhances the aesthetic quality of the golf club head 100, while also increasing the durability of the striking face 130.

Next, a laser etching step 216 may be performed. The laser etching operation 216 may preferably be carried out after the scoreline forming process 212A, 212B, in part so that the scorelines 150 provide a basis for properly and efficiently aligning the feed direction of the laser. However, the laser etching operation may alternatively be performed before or after the first and second groove milling passes. It is conceived that the second groove milling passes 210A, 210B may be insufficient to bring the average surface roughness Ra of the scoreline region 114 into a range compliant with USGA requirements, e.g., Ra1. For example, the second passes 210A, 210B may actually bring the average roughness of this region 114 to about 200 μin. The above-described finishing step 214 in combination with the laser etching step 216 may then be used to bring the average surface roughness Ra of the scoreline region 114 down into the permissible ranges encompassed by Ra1.

Additional other steps may also be performed. For example, an additional sandblasting operation may be carried out immediately after the second groove milling passes 210A and 210B. Additional sandblasting may be performed for a variety of reasons, such as providing a particular aesthetic appearance, and deburring and cleaning the striking face after the milling steps are performed.

Described above are thus a golf club head 100 and methods of its manufacture. The golf club head 100 with an extremely rough toe region 110 possesses numerous advantages over prior club heads, while nonetheless complying with USGA regulations regarding average surface roughness Ra and average maximum profile height Rz. For example, the visual perception of this increased roughness at toe region 110 indicates to the golfer that the remainder of the striking face 130 is similarly roughened and thereby capable of generating more spin on the golf ball, which inspires confidence in the golfer. Further, when in the vicinity of the green, experienced golfers often intentionally strike the golf ball on the toe of the club head as part of, e.g., open face chip shots. The extremely rough toe region 110 of the golf club head 100 enables the golfer to impart more spin on the struck golf ball during such shots. For a shot mishit off the toe region 110, e.g., a "skulled shot," that often has higher velocity and lower trajectory than desired, the increased surface roughness of the toe region 110 may increase the struck golf ball's back spin, thereby reducing the velocity of the mishit shot. And further still, the directionality of the micro-grooves 170 constituting the surface texture of the toe region 110 is easily noticeable at address. As a result, it is easier for the golfer to align the golf club 100 before a shot, and the golfer's confidence in the direction of the shot is correspondingly increased.

Figure 7:
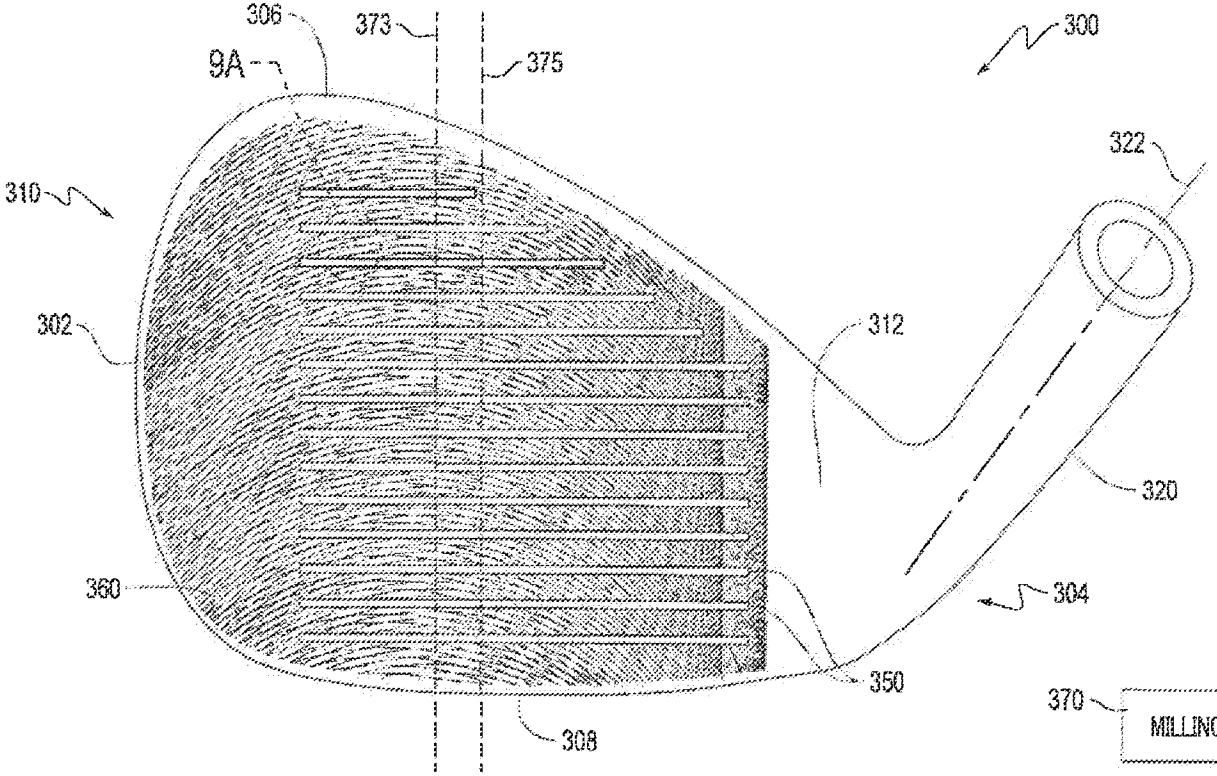
FIG. 7 shows a front elevation view of an exemplary golf club head in accordance with one or more aspects of the present disclosure.
Figure 10:
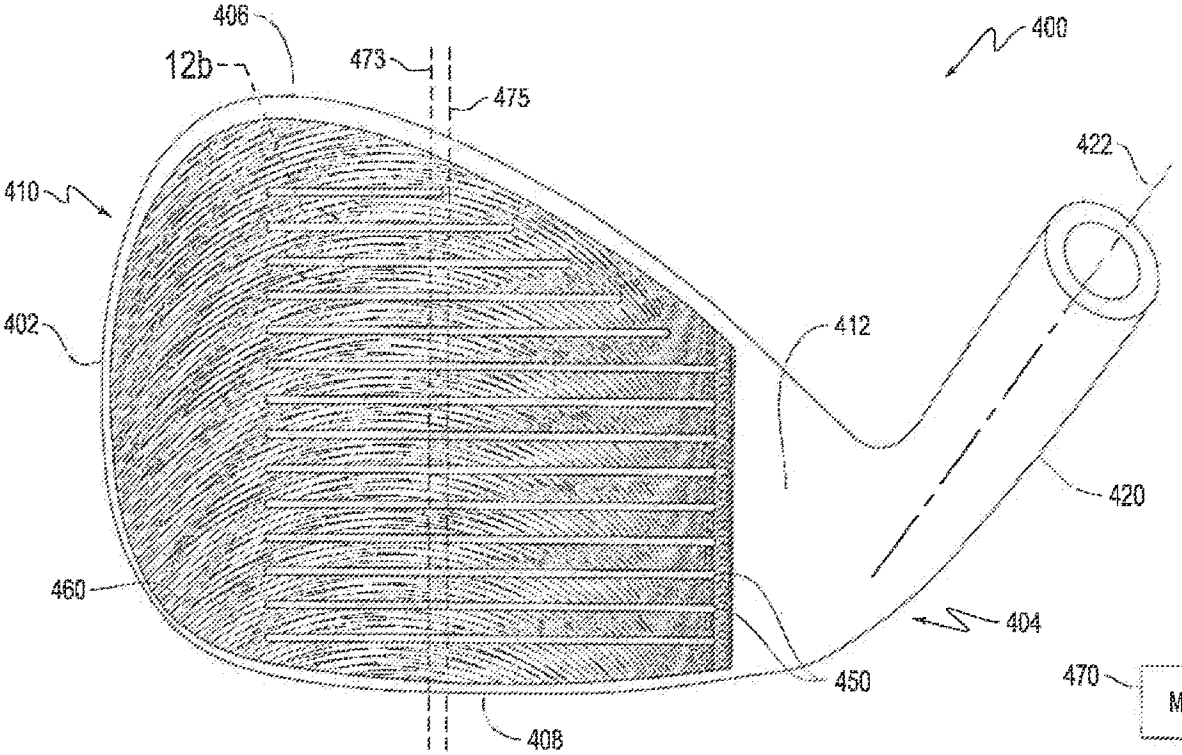
FIG. 10 shows a front elevation view of an exemplary golf club head in accordance with one or more aspects of the present disclosure.

Also envisioned are a golf club head 300 and a golf club head 400, shown in the reference position in FIGS. 7 and 10, respectively. Like the golf club head 100, the club head 300 may include a toe 302, a heel 304 opposite the toe 302, a top line 306, and a sole 308 opposite the top line 306. The golf club head 300 may include, adjacent to the toe 302, a toe region 310, and adjacent to the heel 304, it may further possess a heel region 312. A hosel 320 for securing the golf club head 300 to an associated shaft (not shown) may extend from the heel region 312, and the hosel 320 may in turn define a virtual central hosel axis 322. The golf club head 300 may further include a striking face 330 at a front portion thereof and a rear face (also not shown) opposite to the striking face 330.

Similarly, the golf club head 400 may include a toe 402, a heel 404 opposite the toe 402, a top line 406, and a sole 408 opposite the top line 406. The club head 400 may include, adjacent to the toe 402, a toe region 410, and adjacent to the heel 404, it may further possess a heel region 412. A hosel 420 for securing the golf club head 400 to an associated shaft (not shown) may extend from the heel region 412, and the hosel 420 may in turn define a virtual central hosel axis 422. The golf club head 400 may further include a striking face 430 at a front portion thereof and a rear face (also not shown) opposite to the striking face 430.

The golf club heads 300 and 400 may be formed of the same materials as the golf club head 100, and they may each have a similar mass. That is, the mass of each of the club heads 300 and 400 may preferably be between 200 and 400 g. Even more preferably, the mass of each of the club heads 300 and 400 may be between 250 g and 350 g, and yet even more preferably, it may be between 275 g and 325 g.

The golf club heads 300 and 400 may preferably be of an iron or a wedge type, although they could be a putter-type club head. In particular, the loft angle of each of the club heads 300 and 400 may be greater than 15 degrees and preferably be between 23 and 64 degrees. Even more preferably, the loft angle may be between 40 and 62 degrees, and yet even more preferably, this loft angle may be between 46 and 60 degrees.

Scorelines 350 and 450 may be formed in the striking faces 330 and 430, respectively. The scorelines 350 and 450 may be formed in the same manner and have the same dimensions as the scorelines 150, and they may thus be designed to be in compliance with USGA regulations. More specifically, these scorelines 350 and 450 may preferably have an average width between 0.6 mm and 0.9 mm, more preferably between 0.65 mm and 0.8 mm, and even more preferably between 0.68 mm and 0.75 mm. The scorelines 350 and 450 may also have an average depth from the generally planar surface of their respective striking faces of no less than 0.10 mm, preferably between 0.25 mm and 0.60 mm, more preferably between 0.30 mm and 0.55 mm, and most preferably between 0.36 mm and 0.44 mm. The draft angle of the scorelines 350 and 450 may be between 0 and 25 degrees, more preferably between 10 and 20 degrees, and most preferably between 13 and 19 degrees. And to further comply with USGA regulations, the groove edge effective radius of the scorelines 350 and 450 may be between 0.150 mm and 0.30 mm, more preferably between 0.150 mm and 0.25 mm, and most preferably between 0.150 mm and 0.23 mm. Similar to that described with respect to the golf club head 100 above, the scorelines 350 and 450 are also designed to have a ratio W/(A+S) of less than 0.0030 $in^2$. As would be understood by one of ordinary skill, all of the above dimensions are determined in accordance with the previously-discussed Rules of Golf.

Also like the golf club head 100, micro-grooves 360 and 460 preferably formed by precision mechanical milling, e.g., CNC milling, may be respectively formed in the striking faces 330 and 430 as a pattern of substantially parallel arcuate lines. The micro-grooves 360 and 460 may have an average depth taken from the corresponding striking face of no greater than 1100 μin, more preferably between 400 μin and 1100 μin, and most preferably between 600 μin and 1100 μin. The pitch of these micro-grooves 360 and 460, i.e., the distance between centers of adjacent micro-grooves taken in their direction of propagation, is discussed in detail below. As will be understood by those of ordinary skill in the art, the average depth and pitch of the micro-grooves 360 and 460 will have a significant impact on the roughness characteristics of the striking faces 330 and 430. In particular, to ensure compliance with USGA regulations, the striking faces 330 and 430 may each possess an average surface roughness Ra of preferably less than or equal to 180 μin. More preferably, the average surface roughness Ra may be between 40 μin and 180 μin, even more preferably between 60 μin and 180 μin, and most preferably between 110 μin and 180 μin. And the average maximum profile height Rz of the striking faces 330 and 430 may preferably be less than or equal to 1000 μin. More preferably, the average maximum profile height Rz may be between 200 μin and 1000 μin, even more preferably between 400 μin and 900 μin, and most preferably between 500 μin and 800 μin.

Figure 8:
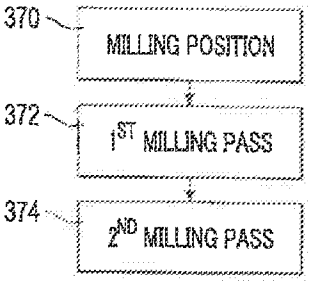
FIG. 8 shows a flow chart detailing a portion of a method of forming a textured striking surface of the golf club head of FIG. 7.

A method for forming the micro-grooves 360 of the golf club head 300 by milling is shown in FIG. 8. The club head 300 may have been previously subjected to various casting, heat treatment, polishing, and preliminary milling operations such as those described in steps 200, 202, 204, and 206 above. In a first step 370, the body of the golf club head 300 may be placed in a milling position where the hosel axis 322 is perpendicular to the ground plain.

The golf club head 300 may then be subjected to a first milling pass 372, in which the milling tool follows the vertical path 373 (shown in FIG. 7) as it moves across the striking face 330 from the sole 308 to the top line 306. During this first milling pass 372, the milling tool is set at an angle with respect to the plane of the striking face 330 sufficient to ensure that the milling tool interacts with the striking face 330 only to create the top half of its circle circumference and thus misses the striking face 330 at the bottom half of the circle circumference. In this manner, the milling tool creates a rotex pattern constituted by some of the arcuate micro-grooves 360 shown in FIG. 7. The pitch of the micro-grooves 360 formed by this first pass 372, i.e, the distance between centers of adjacent ones of these micro-grooves 360 taken in their direction of propagation, may preferably be between 0.01 in and 0.04 in, more preferably between 0.0175 in and 0.0325 in, and even more preferably between 0.025 and 0.03 in.

Thereafter, the golf club head 300 is subjected to a second milling pass 374, in which the milling tool follows the vertical path 375 (shown in FIG. 7) as it moves across the striking face 330 from the sole 308 to the top line 306. The texture pattern created by the first and second milling passes 372 and 374 creates an interference pattern on the striking face 330 that is composed of smaller diamond shapes. Relative to the vertical path 375, the path 373 of the first milling pass 372 may be offset toward the toe 302 between 3 mm and 6 mm, more preferably between 4.5 mm and 5.5 mm, and most preferably by 5 mm. This offset may be visually evident approximate the heel region 312, at which there is a noticeable break in the texture pattern of the striking face 330 that corresponds to the offset of the milling tool. As in the first milling pass 372, the milling tool is set at a sufficient angle with respect to the plane of the striking face 330 during the second milling pass 374, thereby creating another rotex pattern constituted by the remainder of the micro-grooves 360 shown in FIG. 7. Also like the first milling pass, the pitch of the micro-grooves 360 formed by this second pass 374, i.e, the distance between centers of adjacent ones of these micro-grooves 360 taken in their direction of propagation, may preferably be between 0.01 in and 0.04 in, more preferably between 0.0175 in and 0.0325 in, and even more preferably between 0.025 and 0.03 in.

Figure 9B:
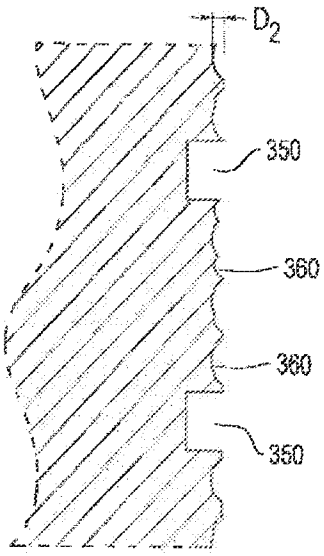
FIG. 9B shows a cross-sectional view of a portion of the golf club head of FIG. 9A taken through the plane 9B-9B.
Figure 9A:
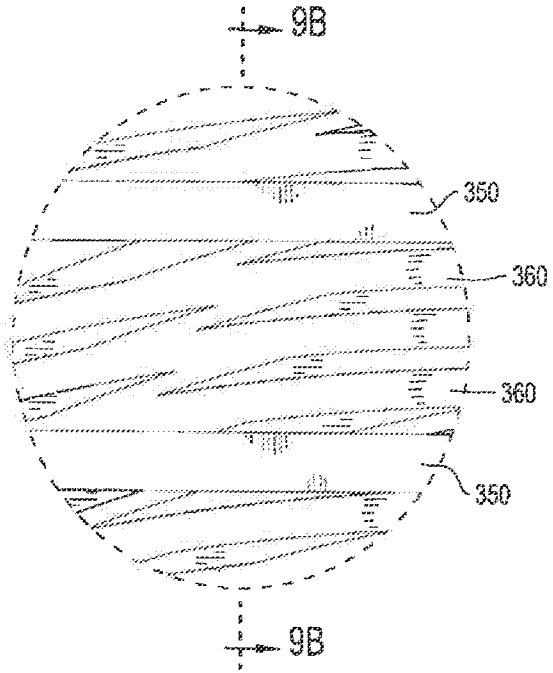
FIG. 9A shows a detailed view of a portion 9A of the golf club head of FIG. 7.

After the first and second milling passes 372 and 374, the golf club head 300 may then be subjected to various additional processes such as the scoreline formation, optional treatment, and laser etching steps previously described in connection with steps 212, 214, and 216. FIG. 9A illustrates a magnified portion of the striking face 330 shown in FIG. 7. FIG. 9B shows a cross-section of the finished striking face 330 taken along the plane 9B-9B in FIG. 9A. Because of the sequential first and second milling passes 372 and 374 that are offset from one another, the distance between adjacent peaks of the micro-grooves 360 varies along the striking face 330 from the top tine 306 to the sole 308.

Figure 11:
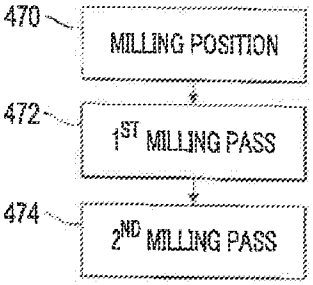
FIG. 11 shows a flow chart detailing a portion of a method of forming a textured striking surface of the golf club head of FIG. 10.

A method for forming the micro-grooves 460 of the golf club head 400 by milling is shown in FIG. 11. The club head 400 may have been previously subjected to various casting, heat treatment, polishing, and preliminary milling operations such as those described in steps 200, 202, 204, and 206 above. As with the golf club head 300, in a first step 470, the body of the club head 400 is placed in a milling position where the hosel axis 422 is perpendicular to the ground plain.

The club head 400 is then subjected to a first milling pass 472, in which the milling tool follows the vertical path 473 as it moves across the striking face 430 from the sole 408 to the top line 406. During this first milling pass 472, the milling tool is set at an angle with respect to the plane of the striking face 430 sufficient to ensure that the milling tool interacts with the striking face 430 only to create the top half of its circle circumference and thus misses the striking face 430 at the bottom half of the circle circumference. In this manner, the milling tool creates a rotex pattern constituted by some of the micro-grooves 460 shown in FIG. 10. Like the step 372, the pitch of the micro-grooves 460 formed by this first pass 472, i.e, the distance between centers of adjacent ones of these micro-grooves 460 taken in their direction of propagation, may preferably be between 0.01 in and 0.04 in, more preferably between 0.0175 in and 0.0325 in, and even more preferably between 0.025 and 0.03 in.

Thereafter, the club head 400 is subjected to a second milling pass 474, in which the milling tool follows the vertical path 475 as it moves across the striking face 430 from the sole 408 to the top line 406. The texture pattern created by the first and second milling passes 472 and 474 creates an interference pattern on the striking face 430 that is composed of larger diamond shapes. Relative to the vertical path 475, the path 473 of the first milling pass 472 may be offset toward the toe 402 between 1 mm and 3 mm, more preferably between 1.5 mm and 2.5 mm, and most preferably by 2 mm. This offset may be visually evident approximate the heel region 412, at which there is a noticeable break in the texture pattern of the striking face 430 that corresponds to the offset of the milling tool. As in the first milling pass 472, the milling tool is set at an angle with respect to the plane of the striking face 430 during the second milling pass, thereby creating another rotex pattern constituted by the remainder of the micro-grooves 460 shown in FIG. 10. Also like the first milling pass 472, the pitch of the micro-grooves 460 formed by this second pass 474, i.e, the distance between centers of adjacent ones of these micro-grooves 460 taken in their direction of propagation, may preferably be between 0.01 in and 0.04 in, more preferably between 0.0175 in and 0.0325 in, and even more preferably between 0.025 and 0.03 in.

Figure 12B:
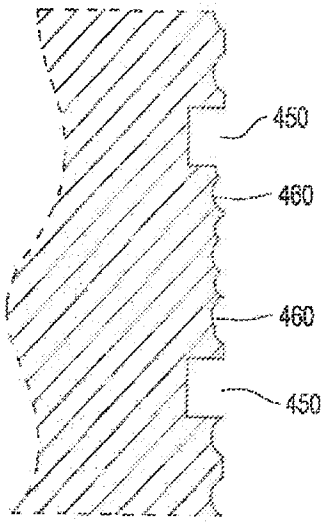
FIG. 12B shows a cross-sectional view of a portion of the golf club head of FIG. 12A taken through the plane 12B-12B.
Figure 12A:
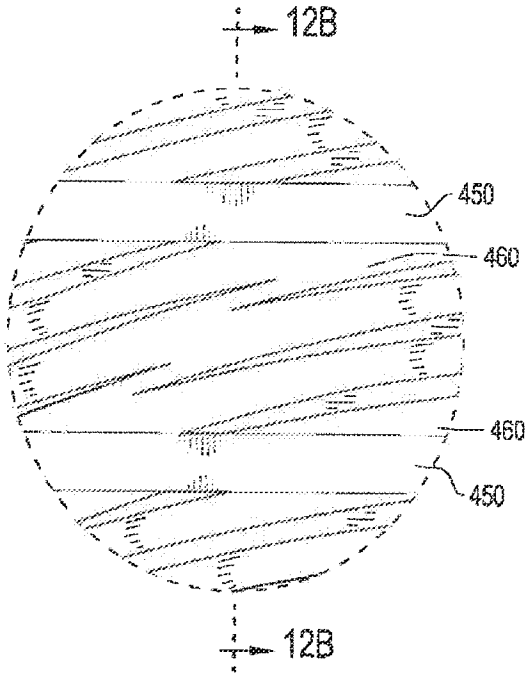
FIG. 12A shows a detailed view of a portion 12A of the golf club head of FIG. 10.

After the first and second milling passes 472 and 474, the golf club head 400 may be subjected to various additional processes such as the scoreline formation, optional treatment, and laser etching steps previously described in connection with steps 212, 214, and 216. FIG. 12A illustrates a magnified portion of the striking face 430 shown in FIG. 10. FIG. 12B shows a cross-section of the finished striking surface 430 taken along the plane 12B-12B in FIG. 10. Because of the sequential first and second milling passes 472 and 474 that are offset from one another, the distance between adjacent peaks of the micro-grooves 460 varies along the striking face 430 from the top line 406 to the sole 408.

Figure 14:
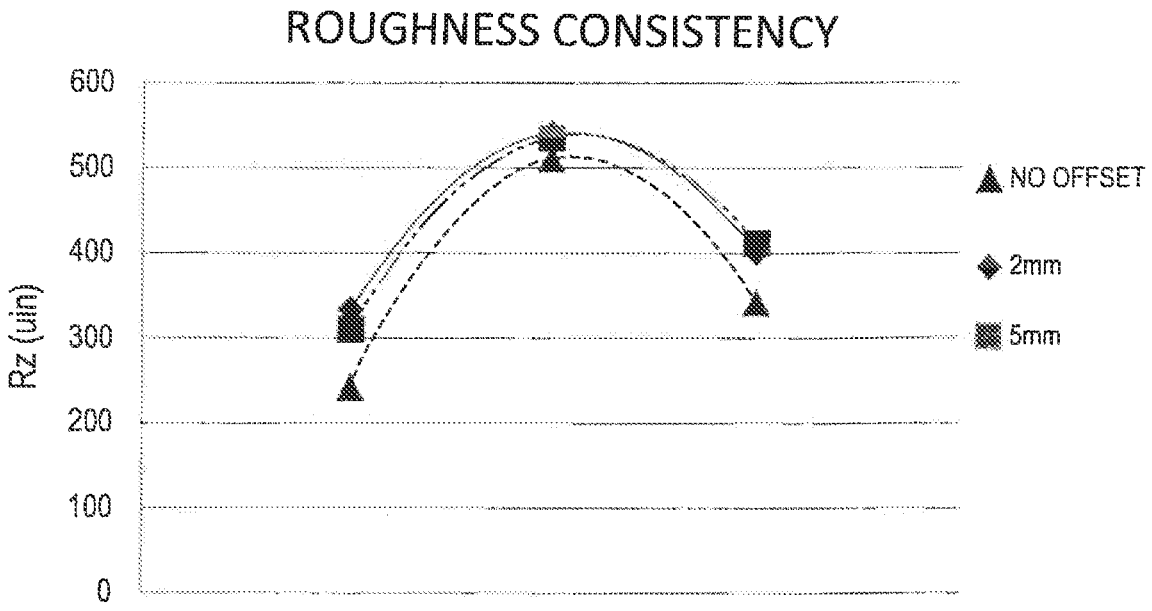
FIG. 14 shows a plot of roughness consistency for various offsets.

The respective combinations of the first milling passes 372, 472 with the second milling passes 374, 474 thus create interference patterns on the striking faces 330 and 430 that are constituted by diamonds. The diamonds are created by the grooves from the second milling passes 374, 474 being superimposed over the grooves from the first milling passes 372, 472, respectively. These interference patterns each create more consistent roughness across the corresponding striking face, including having peak roughness at locations on the face where impact is most common, e.g., along the vertical centerline of the striking face. For example, as shown in FIG. 14, average maximum profile height Rz peaks for both the striking face 330, i.e., 5 mm offset, and the striking face 430, i.e., 2 mm offset, around the center of the striking face. The interference patterns described above also create more spin from the rough and in wet conditions, as is evidenced by the increase in average maximum profile height Rz for the striking faces 330 and 430 compared to a striking face with no offset.

As mentioned previously, the interference pattern on the striking face 330 is constituted by smaller diamonds. When the golf club head 300 is in the closed, or normal position at address, the directionality of this interference pattern faces thus toward the target. This is particularly advantageous in the context of lower-lofted clubs, i.e., clubs with a loft angle of 52 degrees and below, which often face the golf ball at address with the club head in this closed, or normal position. The club head 300 may thus be such a lower-lofted club head. The interference pattern on the striking face 430 is constituted by larger diamonds, however. Higher lofted clubs, i.e., those with a loft angle of 54 degrees and greater, often face the golf ball at address with the club face in an open position. In prior art golf clubs, this open position, which is desired for many sand bunker shots, lob shots, and chip shots, results in the club face appearing offline, e.g., aimed to the right of the target. The directionality of the interference pattern on the striking face 430, however, cures this visual issue by creating the appearance that the micro-grooves 460 are directed toward the target, even though the face is open. The golf club head 400 may thus be such a higher-lofted club head.

Figure 13:
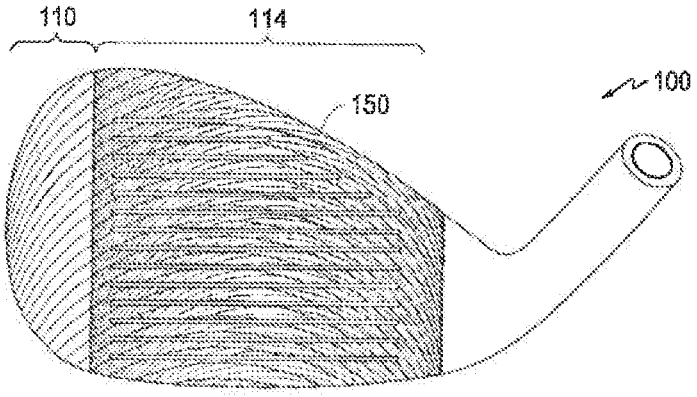
FIG. 13 shows a front elevation view of an exemplary golf club head in accordance with one or more aspects of the present disclosure.

In the foregoing discussion, the present invention has been described with reference to specific exemplary aspects thereof. However, it will be evident that various modifications and changes may be made to these exemplary aspects without departing from the broader spirit and scope of the invention. For example, although FIG. 6E shows an embodiment in which the micro-grooves from the first milling pass 208B are removed in the scoreline region 114 by the second groove milling pass 210B, in some implementations, the grooves from the second groove milling pass 210B may be entirely superimposed onto the grooves of the first groove milling pass 208B. As a result, both groove patterns may be visually discernible in the scoreline region 114 while still maintaining Ra1 values in the scoreline region 114 and Ra2 values in the toe region 110, as shown in FIG. 13. Accordingly, the foregoing discussion and the accompanying drawings are to be regarded as merely illustrative of the present invention rather than as limiting its scope in any manner.

What is claimed:

1. A method of manufacturing a golf club head, the method comprising:

(a) providing an intermediate golf club head body that, when oriented in a reference position, has a heel portion, a toe portion, a top portion, a bottom portion, and a striking face having a striking face periphery;

(b) texturing a first region of the striking face by surface milling in a first pass forming a plurality of grooves; and (c) texturing a second region of the striking face subsequent to step (b) by surface milling in a second pass, the second region partially overlapping the first region thereby dividing the first region into an overlapped sub-region and a non-overlapped sub-region, wherein, in step (c), the second region is surface milled at a depth thereby removing material that forms the plurality of grooves located within the overlapped sub-region.

2. The method of claim 1, further comprising:

forming a plurality of scorelines in the striking face, wherein:

a first virtual vertical plane perpendicular to the striking face passes through a toe-wardmost extent of the scorelines;

a second virtual vertical plane parallel to the first virtual vertical plane passes through a heel-wardmost extent of the scorelines; and the non-overlapped sub-region of the first region is located entirely toe-ward of the first vertical plane.

3. The method of claim 2, wherein the step of forming a plurality of scorelines occurs subsequent to the steps (a), (b), and (c).

4. The method of claim 1, further comprising media blasting a portion of the striking face including at least the second region.

5. The method of claim 1, wherein the first region exhibits a first average surface roughness, Ra1, and the second region exhibits a second average surface roughness, Ra2, such that Ra1 is at least two times greater than Ra2.

6. The method of claim 5, wherein Ra2 is at least 90 μin less than Ra1.

7. The method of claim 1, wherein, subsequent to step (c), the second region undergoes additional texturing such that the second region exhibits a final average surface roughness Ra3 of less than 180 μin.

8. The method of claim 1, wherein step (c) further comprises forming a visually discernible step between the first region and the second region.

9. The method of claim 3, wherein the first region defines a first heelward boundary and the second region defines a second heelward boundary that is coincident with the first heelward boundary.

10. The method of claim 1, further comprising laser etching a portion of the second region.

11. A method of manufacturing a golf club head, the method comprising:

(a) providing an intermediate golf club head body that, when oriented in a reference position, has a heel portion, a toe portion, a top portion, a bottom portion, and a striking face having a striking face periphery;

(b) texturing a first region of the striking face forming a plurality of grooves;

(c) texturing a second region of the striking face subsequent to step (b), the second region partially overlapping the first region thereby dividing the first region into an overlapped sub-region and a non-overlapped sub-region, wherein, in step (c), the second region is milled at a depth thereby removing material forming the plurality of grooves located within the overlapped sub-region; and (d) forming a plurality of scorelines in the striking face, wherein:

a first virtual vertical plane perpendicular to the striking face passes through a toe-wardmost extent of the scorelines; and a second virtual vertical plane parallel to the first virtual vertical plane passes through a heel-wardmost extent of the scorelines, wherein, the non-overlapped sub-region of the first region is located entirely toe-ward of the first vertical plane.

12. The method of claim 11, wherein the step (d) of forming a plurality of scorelines occurs subsequent to the steps (a), (b), and (c).

13. The method of claim 11, further comprising media blasting a portion of the striking face including at least the second region.

14. The method of claim 11, wherein the first region exhibits a first average surface roughness, Ra1, and the second region exhibits a second average surface roughness, Ra2, such that Ra1 is at least two times greater than Ra2.

15. The method of claim 14, wherein Ra2 is at least 90 μin less than Ra1.

16. The method of claim 11, wherein, subsequent to step (c), the second region undergoes additional texturing such that the second region exhibits a final average surface roughness Ra3 of less than 180 μn.

17. The method of claim 11, wherein step (c) further comprises forming a visually discernible step between the first region and the second region.

18. The method of claim 11, wherein the first region defines a first heelward boundary and the second region defines a second heelward boundary that is coincident with the first heelward boundary.

19. The method of claim 11, further comprising laser etching a portion of the second region.

* * * * *